US009431744B2

(12) United States Patent
Kataoka et al.

(10) Patent No.: US 9,431,744 B2
(45) Date of Patent: Aug. 30, 2016

(54) CONNECTOR WITH RETAINER HAVING EXTENDED PUSHING SURFACE AND POSTURE CORRECTING PORTION

(71) Applicant: Sumitomo Wiring Systems, Ltd., Yokkaichi (JP)

(72) Inventors: Shigeto Kataoka, Yokkaichi (JP); Mitsunori Kitajima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/449,603

(22) Filed: Aug. 1, 2014

(65) Prior Publication Data

US 2015/0038022 A1 Feb. 5, 2015

(30) Foreign Application Priority Data

Aug. 5, 2013 (JP) ..... 2013-162522

(51) Int. Cl.
*H01R 13/514* (2006.01)
*H01R 13/424* (2006.01)
*H01R 13/426* (2006.01)

(52) U.S. Cl.
CPC ..... *H01R 13/424* (2013.01); *H01R 13/426* (2013.01)

(58) Field of Classification Search
CPC ..... H01R 13/4362; H01R 13/4223; H01R 13/424; H01R 13/426
USPC ..... 439/752, 595
See application file for complete search history.

(56) References Cited

U.S. PATENT DOCUMENTS

| | | | | |
|---|---|---|---|---|
| 6,551,145 | B2 * | 4/2003 | Kurimoto et al. | 439/752 |
| 7,204,725 | B2 * | 4/2007 | Yamashita | 439/752 |
| 7,261,603 | B2 * | 8/2007 | Takahashi et al. | 439/752 |
| 2008/0020653 | A1 * | 1/2008 | Horiuchi | 439/752 |

FOREIGN PATENT DOCUMENTS

JP 10-092502 4/1998

OTHER PUBLICATIONS

Translation. JP 10-092502. Double Lock Connector. Miyamoto Toshibumi; Sakatani Atsushi. Published Oct. 4, 1998.*

* cited by examiner

*Primary Examiner* — Amy Cohen Johnson
*Assistant Examiner* — Milagros Jeancharles
(74) *Attorney, Agent, or Firm* — Gerald E. Hespos; Michael J. Porco; Matthew T. Hespos

(57) ABSTRACT

A retainer (10) is formed from a body (18) and extended portions (11). The body (18) includes two deflectable legs (20) and the legs (20) include locking claws (21) to be held onto a male connector housing (1) at a partial locking position and locking protrusions (22) to be locked to the male terminal fittings (5). A pushing surface (19) of the retainer (10) is extended in a front-back direction by the extended portions (11). A posture correcting portion (23) is formed between the legs (20) and fits into a cut recess (15) of a partition wall (14) to be locked therein when the retainer (10) is at a full locking position, thereby restricting an oblique posture of the retainer (10).

3 Claims, 18 Drawing Sheets

CONNECTOR WITH RETAINER HAVING EXTENDED PUSHING SURFACE AND POSTURE CORRECTING PORTION

BACKGROUND OF THE INVENTION

1. Field of the Invention

The present invention relates to a connector.

2. Description of the Related Art

A conventional connector uses a locking lance and a retainer for doubly locking a terminal fitting in a housing. The retainer includes a body with a terminal locking portion to be locked to the terminal fitting and a housing locking portion to be locked to the housing. In recent years, there has been a strong request to miniaturize connector housings and retainers also have been miniaturized in response to this request. As a result, a pushing surface used to push a retainer into the housing becomes smaller, thereby making a pushing operation difficult.

Japanese Unexamined Patent Publication No. H10-92502 addresses this difficulty by providing a connector with a pushing surface that extends forward from the upper surface of a body via a coupling in a central part. However, a pushing surface that extends toward the front in this way causes the retainer to incline so that the extended front is lowered when being pushed into the housing. This makes it difficult to mount the retainer smoothly.

The invention was completed based on the above situation and aims to provide a connector enabling a smooth mounting operation of a retainer even if a pushing surface is extended.

SUMMARY OF THE INVENTION

The invention is directed to a connector that includes a housing formed with cavities and terminal fittings accommodated in the cavities. The housing includes a retainer insertion hole and the connector further includes a retainer that is to be inserted into the retainer insertion hole. The retainer is configured to lock and retain the terminal fittings in a mounted state in the cavities. The retainer includes a body with a housing lock to be locked to an inner part of the housing and terminal locks to be locked to the terminal fittings. A pushing surface is formed at a rear end of retainer in an inserting direction of the retainer into the housing and an extended portion extends from the pushing surface in a connecting direction that intersects the inserting direction of the retainer. The extended portion is substantially continuous and flush with the pushing surface. A posture correcting portion restricts inclination of the retainer by contacting the housing in a direction along an extending direction of the extended portion when the retainer is mounted into the housing.

The pushing surface is extended by forming the extended portion from the body in the direction intersecting the inserting direction. Thus, the retainer easily can be pushed in a proper direction even if the retainer is made smaller. Further, the extended portion is extended toward one side of the body. Thus, the entire retainer may be inserted in a posture inclined with respect to an extending direction of the extended portion when the extended portion is pushed. However, the posture correcting portion contacts the extended portion in the extending direction of the extended portion when the retainer is inserted into the retainer insertion hole to restrict inclination of the retainer. Thus, the retainer can be inserted into the retainer insertion hole in a proper posture so that the retainer can be mounted smoothly.

Two of the housing locks preferably are formed on the body and extend along the inserting direction of the retainer. The locks preferably are deflectable in a width direction. The posture correcting portion preferably extends along the inserting direction of the retainer between the housing locks in the body and can fit into a recess formed by cutting a partition wall between the cavities that are adjacent in the width direction along the connecting direction.

There is concern that the laterally deflectable housing locks may permit the retainer to rattle in the width direction. However, the posture correcting portion is fit into the recess of the partition wall in the mounted state of the retainer and is sandwiched between the terminal fittings accommodated in the adjacent cavities. Thus, the posture correcting portion contacts the terminal fitting to restrict displacement of the retainer in the width direction. The posture correcting portion also contacts front and rear walls of the recess in the connecting direction to restrict rattling of the retainer in the connecting direction.

The posture correcting portion contacts the housing locks when the housing locks are deformed within a resiliency limit, and thereby prevents excessive deflection of the housing locks.

The retainer may have a protruding backlash restricting portion, and the housing may have a positioning recess that receives and tightly holds the backlash restricting portion in the connecting direction when mounting the retainer into the housing. Thus, the retainer is positioned in the connecting direction.

DETAILED DESCRIPTION OF THE PREFERRED EMBODIMENTS

Figure 1:
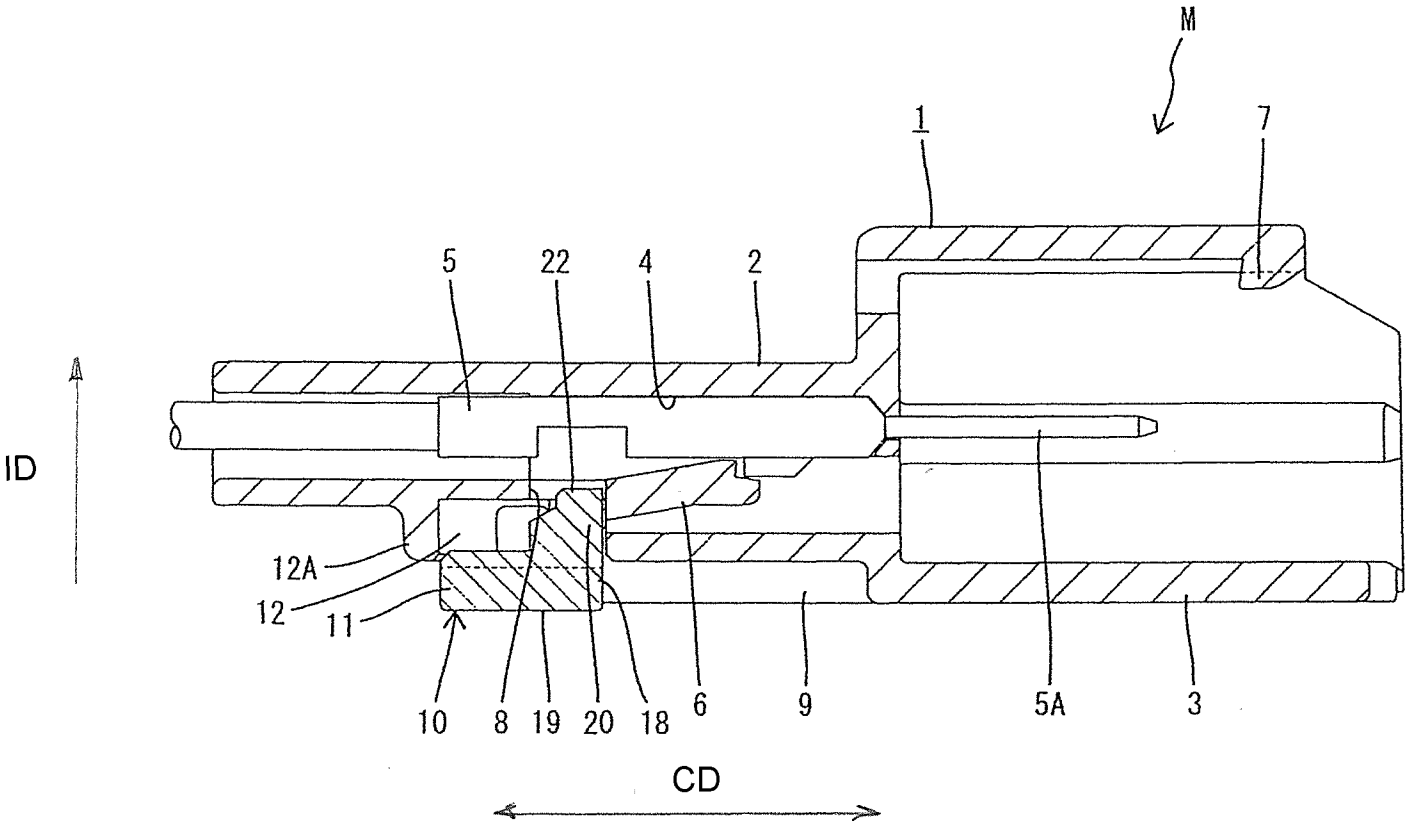
FIG. 1 is a side view in section when a retainer is at a partial locking position in a male connector.

A specific embodiment of a connector of the invention is described with reference to the drawings. Note that, in the following description, front and rear ends in a connecting direction CD of male and female connectors are referred to as a "front"and a "rear" and a direction extending from a front to a back of the plane of FIG. 1 is referred to as a "width direction " WD.

Figure 2:
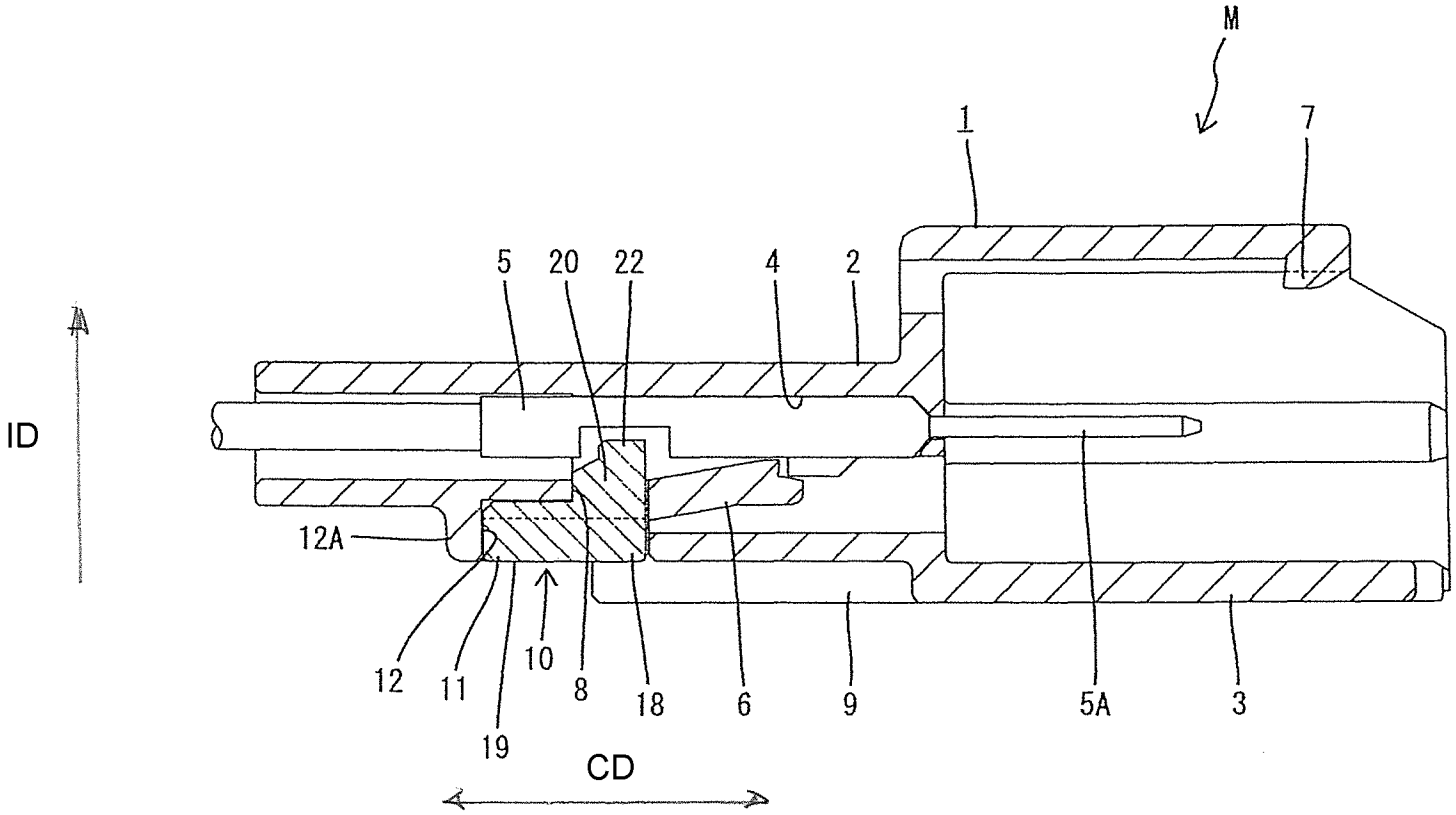
FIG. 2 is a side view in section when the retainer is at a full locking position.
Figure 9:
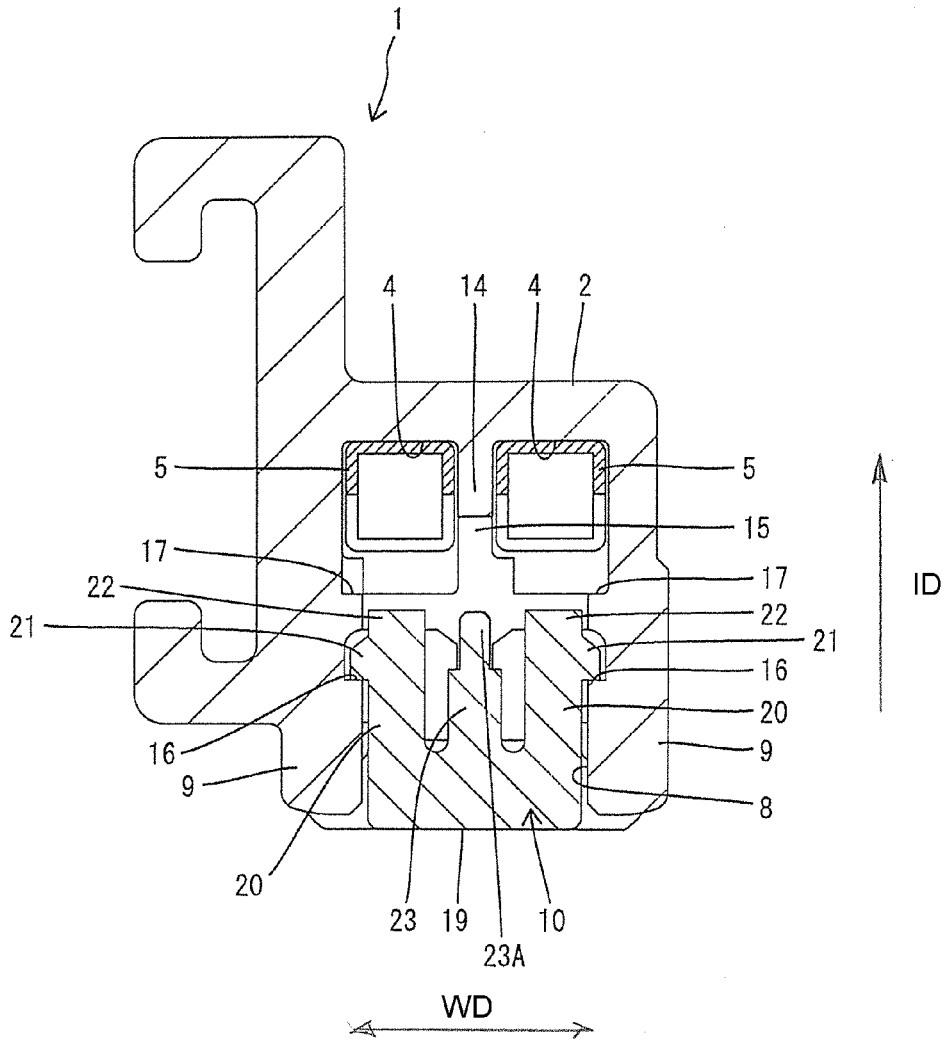
FIG. 9 is a section along A-A of FIG. 4 when the retainer is at the partial locking position.
Figure 10:
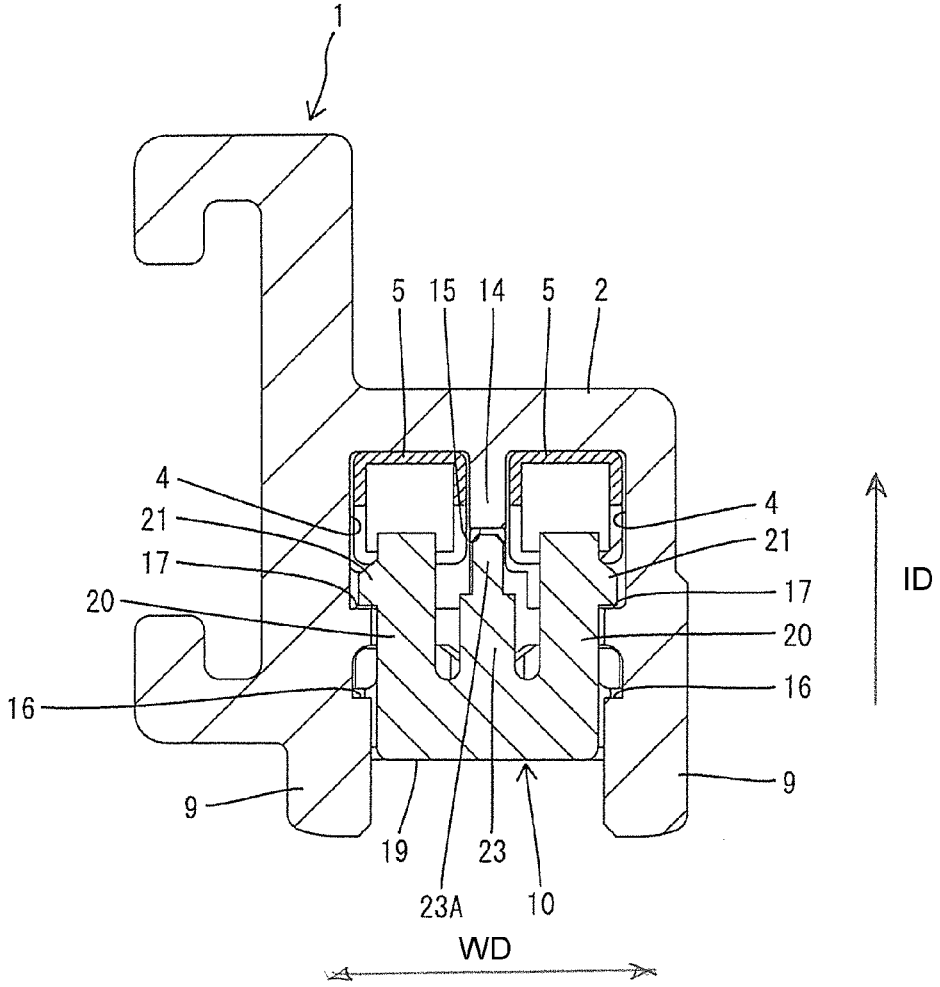
FIG. 10 is a section along A-A of FIG. 4 when the retainer is at the full locking position.

A male connector in accordance with the invention is identified by the letter M and includes a male housing 1 made of synthetic resin. A rear end of the male housing 1 in the connecting direction CD to a female connector F defines a terminal accommodating portion 2, and a rectangular tubular receptacle 3 is formed at a front end. As shown in FIGS. 9 and 10, two cavities 4 are arranged side by side in the width direction WD in the terminal accommodating portion 2. Each cavity 4 is capable of accommodating a male terminal fitting 5, and a locking lance 6 is provided substantially in a central part in the cavity 4 for primarily locking the male terminal fitting 5. As shown in FIGS. 1 and 2, the locking lance 6 is cantilevered obliquely forward and is resiliently deformable in a vertical direction in FIGS. 1 and 2.

Tabs 5A of the male terminal fittings 5 are arranged side by side in the width direction and project into the receptacle 3. A lock 7 projects down at a widthwise central part of the upper side of the opening edge of the receptacle 3.

Figure 3:
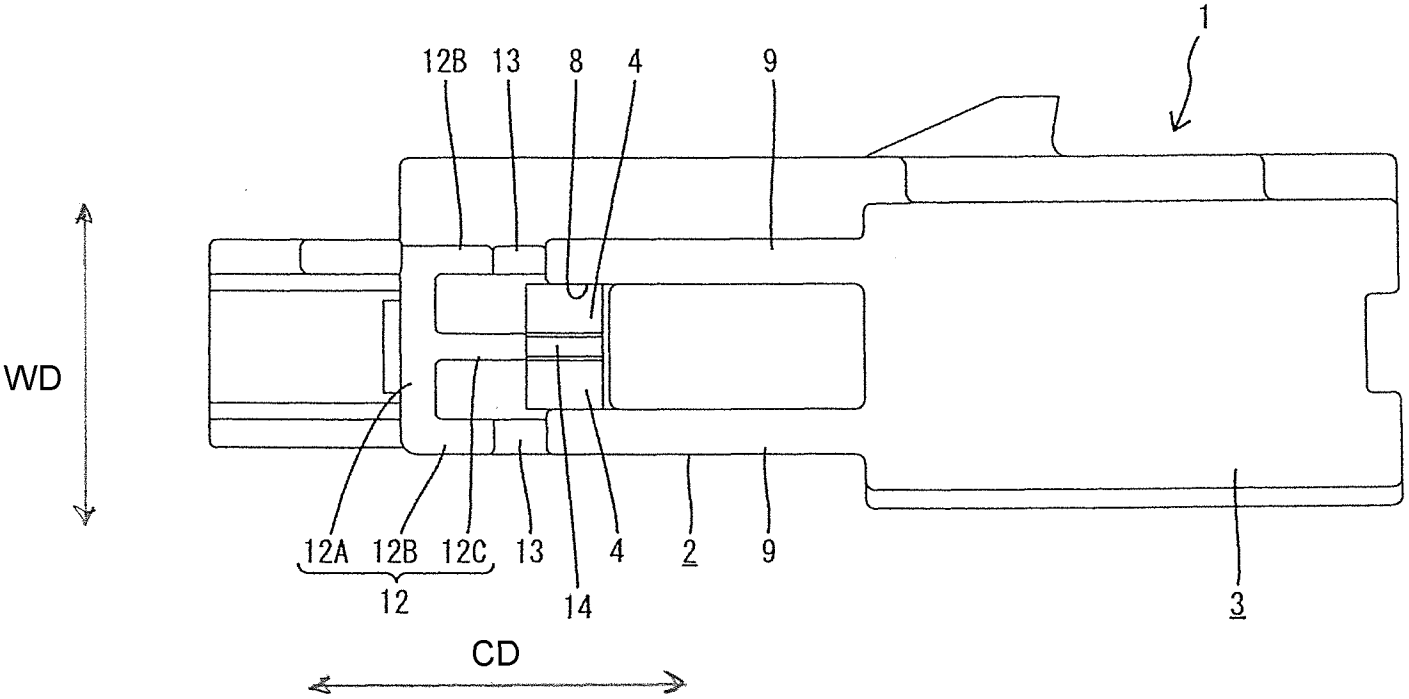
FIG. 3 is a bottom view of a male connector housing.

A retainer insertion hole 8 is open on the lower surface of the terminal accommodating portion 2 at a position behind the locking lances 6 and communicates with the cavities 4. As shown in FIGS. 1 and 3, in an area of the lower surface of the terminal accommodating portion 2 located before the retainer insertion hole 8 and extending up to the receptacle 3, a widthwise central part is formed to be slightly higher while leaving opposite side edge parts in the width direction. Thus, two elongated projections 9 are formed on and along the opposite widthwise side edges of the lower surface of the terminal accommodating portion 2 (see FIG. 3). The front ends of both elongated projections 9 are continuous and flush with the lower surface of the receptacle 3, and the rear ends thereof are located at positions slightly before the rear opening edge of the retainer insertion hole 8 (see FIGS. 1 and 3). An accommodating frame 12 for accommodating extended portions 11 of a retainer 10 to be described later projects on a side of the lower surface of the terminal accommodating portion 2 behind the retainer insertion hole 8.

The accommodating frame 12 has a rear wall 12A extending over the entire width of the terminal accommodating portion 2, two side walls 12B and a center wall 12C. The side walls 12B extend forward from the opposite widthwise ends of the rear wall 12A and are arranged on the same straight lines as the elongated projections 9. The center wall 12C extends forward from a widthwise central part of the rear wall 12A, and the heights of the walls 12A, 12B and 12C are substantially flush with a part between the elongated projections 9. Further, the front ends of the opposite side walls 12B are slightly behind the front end of the center wall 12C and two positioning recesses 13 are defined between the front ends of the side walls 12B and the rear ends of the elongated projections 9.

Figure 8:
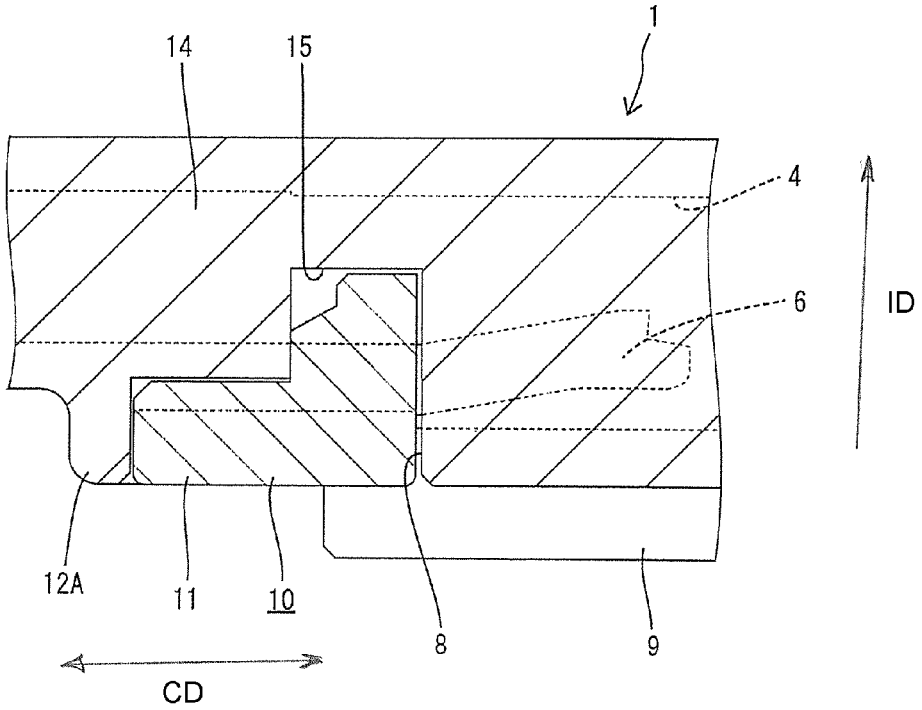
FIG. 8 is an enlarged section showing a state where a posture correcting portion of the retainer is fitted in a recess of a partition wall to hold the retainer in a proper posture.

Further, a cut recess 15 is formed at a position of a partition wall 14 between the cavities 4 in an arrangement direction where the retainer insertion hole 8 is open and has a width substantially equal to the width of the retainer insertion hole 8 in a front-back direction (see FIGS. 3 and 8).

As shown in FIGS. 9 and 10, partial lock receiving portions 16 and full lock receiving portions 17 are provided on widthwise outer wall surfaces of a wall of the retainer insertion hole 8 while being paired in the width direction. The partial lock receiving portions 16 are provided at shallow positions in the retainer insertion hole 8 and the full lock receiving portions 17 are provided at positions deeper than the partial lock receiving portions 16. The partial lock receiving portions 16 are for holding the retainer 10 at a partial locking position (position shown in FIGS. 1 and 9) and the full lock receiving portions 17 are for holding the retainer 10 at a full locking position (position shown in FIGS. 2 and 10).

Figure 4:
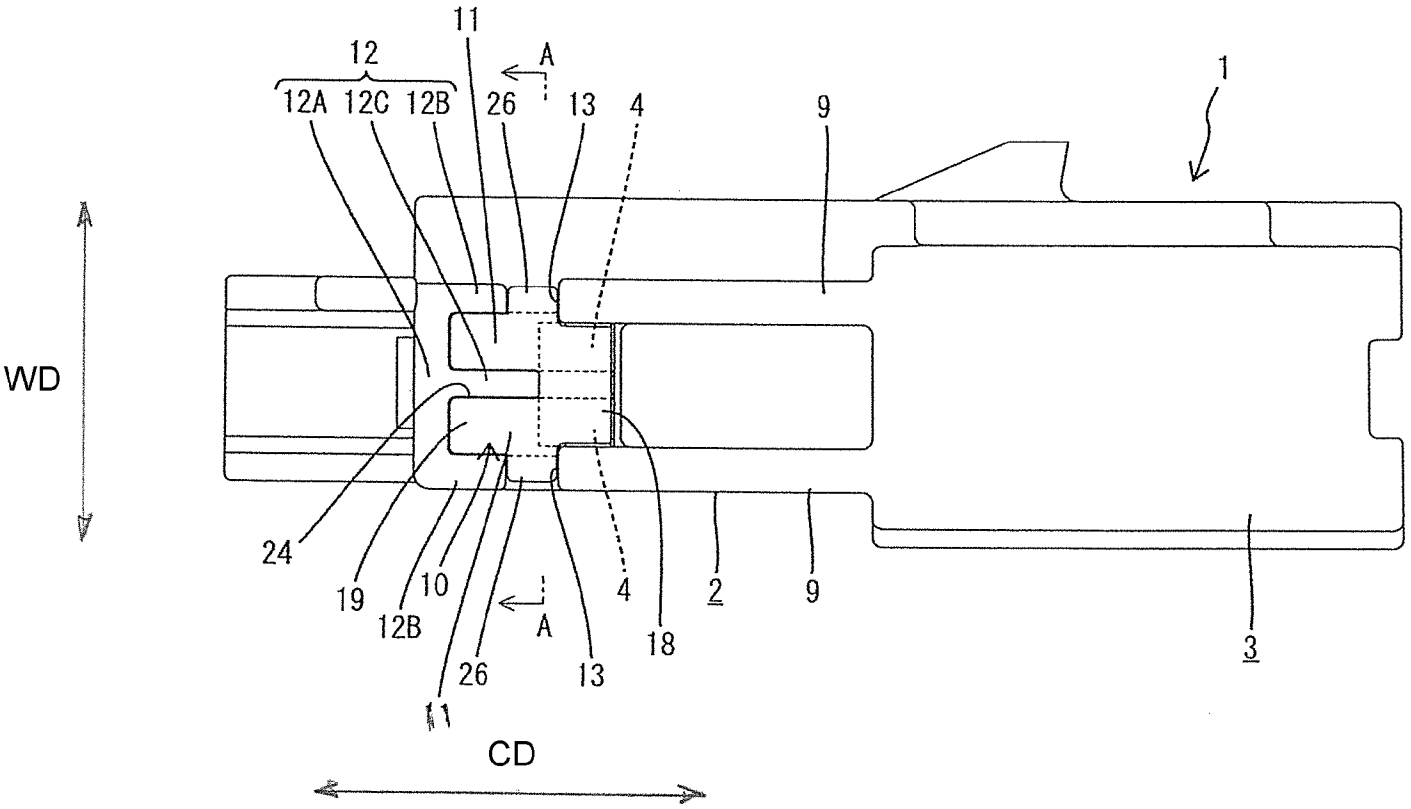
FIG. 4 is a bottom view of the male connector when the retainer is at the partial locking position or at the full locking position.
Figure 5:
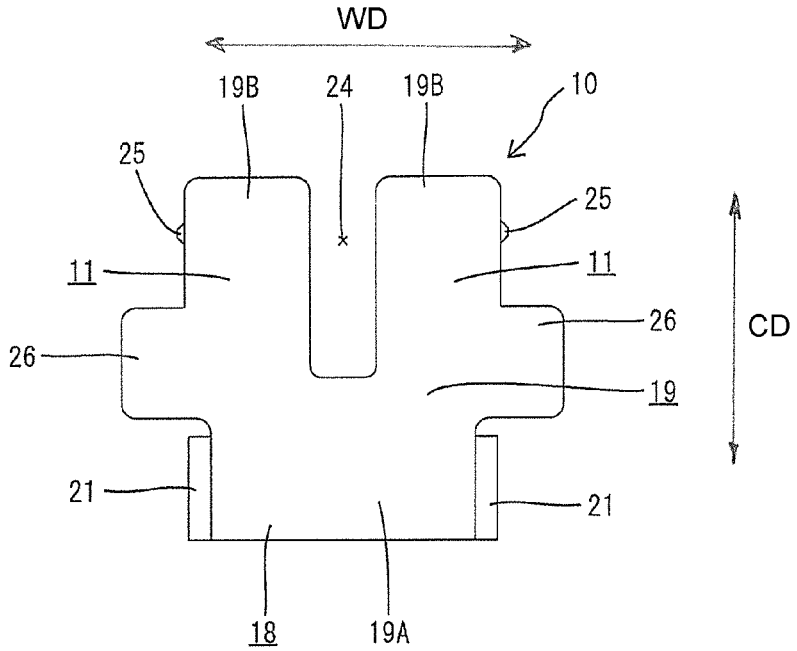
FIG. 5 is a bottom view of the retainer.
Figure 6:
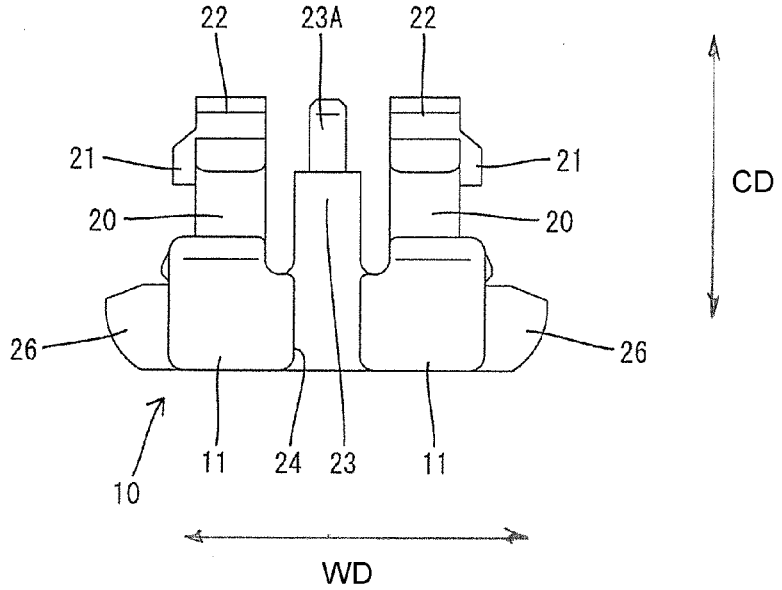
FIG. 6 is a front view of the retainer.
Figure 7:
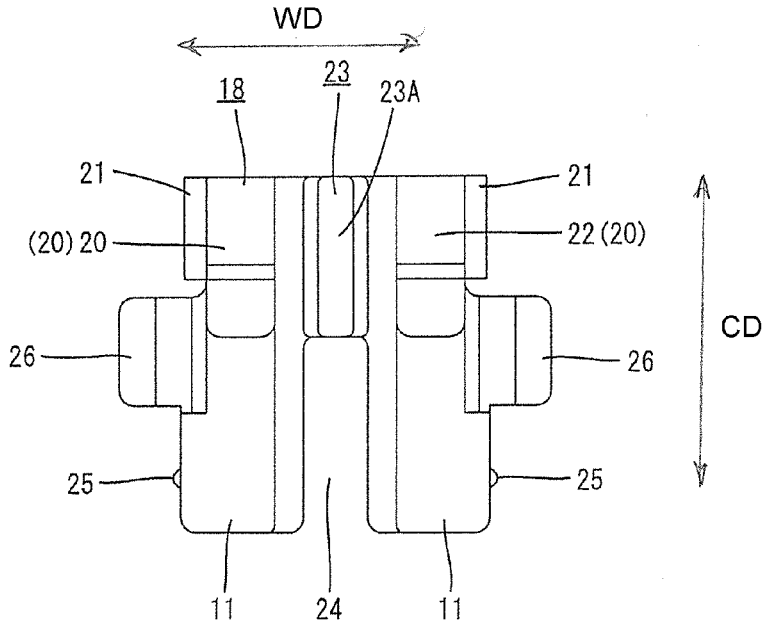
FIG. 7 is a plan view of the retainer.

FIGS. 5 to 7 show the retainer 10 of the male connector M. The retainer 10 is formed unitarily of synthetic resin to define a body 18 for locking the male terminal fittings 5 and the extended portions 11 for extending a pushing surface 19 of the retainer 10. As shown in FIG. 4, the entire retainer 10 can fit into the accommodating frame 12 of the male housing 1 in an inserting direction ID, and the lower surface (pushing surface 19) of the retainer 10 is substantially flush with the elongated projections 9 and the respective walls of the accommodating frame 12 when the retainer is at the full locking position.

A flat body side pushing surface 19A is formed on the lower surface of the body 18. Two legs 20 (housing locks) project up on opposite widthwise side parts of the upper surface of the body 18. Locking claws 21 project on outer surfaces of the legs 20 near the tips of the legs 20. The legs 20 can be deformed resiliently toward each other so that the locking claws 21 can be locked releasably to the partial lock receiving portions 16 and the full lock receiving portions 17 described above.

Sides of the legs 20 closer to the tips than the locking claws 21 define locking protrusions 22 capable of locking the male terminal fittings 5. The locking protrusions 22 are below the corresponding cavities 4 when the retainer 10 is at the partial locking position shown in FIGS. 1 and 9. Thus, at the partial locking position, the male terminal fittings 5 can be inserted into and withdrawn from the cavities 4. On the other hand, the locking protrusions 22 are in the corresponding cavities 4 when the retainer 10 is at the full locking position, as shown in FIGS. 2 and 10, to lock the male terminal fittings 5 and doubly retain the male terminal fittings 5 together with the locking lances 6.

A posture correcting portion 23 projects up in a widthwise central part of the upper surface of the body portion 18 between the legs 20. The posture correcting portion 23 has a width equal to the width of the body 18 in the front-back direction. As shown in FIG. 6, a narrow portion 23A is formed at a tip and is narrow in the width direction. When the retainer 10 is at the full locking position, the narrow portion 23A is fit in the recess 15 in the partition wall 14 between the cavities 4. A width of the narrow portion 23A in the front-back direction is slightly less than the width of the recess 15 in the front-back direction. Thus, an inclined posture of the entire retainer 10 in the front-back direction can be restricted by the contact of the front or rear surface of the narrow portion 23A with the front or rear surfaces of the recess 15. Further, a thickness of the narrow portion 23A in the width direction is substantially equal to the width of the partition wall 14. Thus, when the retainer 10 is at the full locking position, the narrow portion 23A constitutes a part of the partition wall 14.

The narrow portion 23A also has an excessive deformation preventing function of preventing the leg portions 20 from being deformed excessively by contacting the widthwise inner surfaces of the legs 20 when the legs 20 are resiliently deformed inwardly (toward each other) within a resiliency limit.

The extended portions 11 integrally protrude back from the body 18. Extended-portion side pushing surfaces 19B extend continuously on the upper surfaces of the extended portions 11 and are flush with the body side pushing surface 19A of the body 18. As shown in FIG. 5, the extended portions 11 are forked in the width direction via a U-shaped groove 24 that extends in the front-back direction from the rear end edge. As shown in FIG. 4, the center wall 12C of the accommodating frame 12 is fit tightly into the U-shaped groove 24 of the retainer 10 at the full locking position. As shown in FIG. 5, backlash filling projections 25 project in the width direction on widthwise outer side surfaces of the extended portions 11. When the retainer 10 is at the full locking position, the extended portions 11 are fit between the center wall 12C and the opposite side walls 12B and the backlash filling projections 25 are squeezed by the inner surfaces of the opposite side walls 12B. In this way, the extended portions 11 are sandwiched tightly between the center wall 12C and the side walls 12B and the entire retainer 10 can be held without play.

Two backlash restricting portions 26 project outward in the width direction on boundaries between the extended portions 11 and the body 18 on opposite side parts of the retainer 10 in the width direction. When the retainer 10 is at the full locking position, the both backlash restricting portions 26 are fit tightly fitted into the corresponding positioning recesses 13 of the male housing 1 so that the retainer 10 is held without play in the front-back direction.

Figure 11:
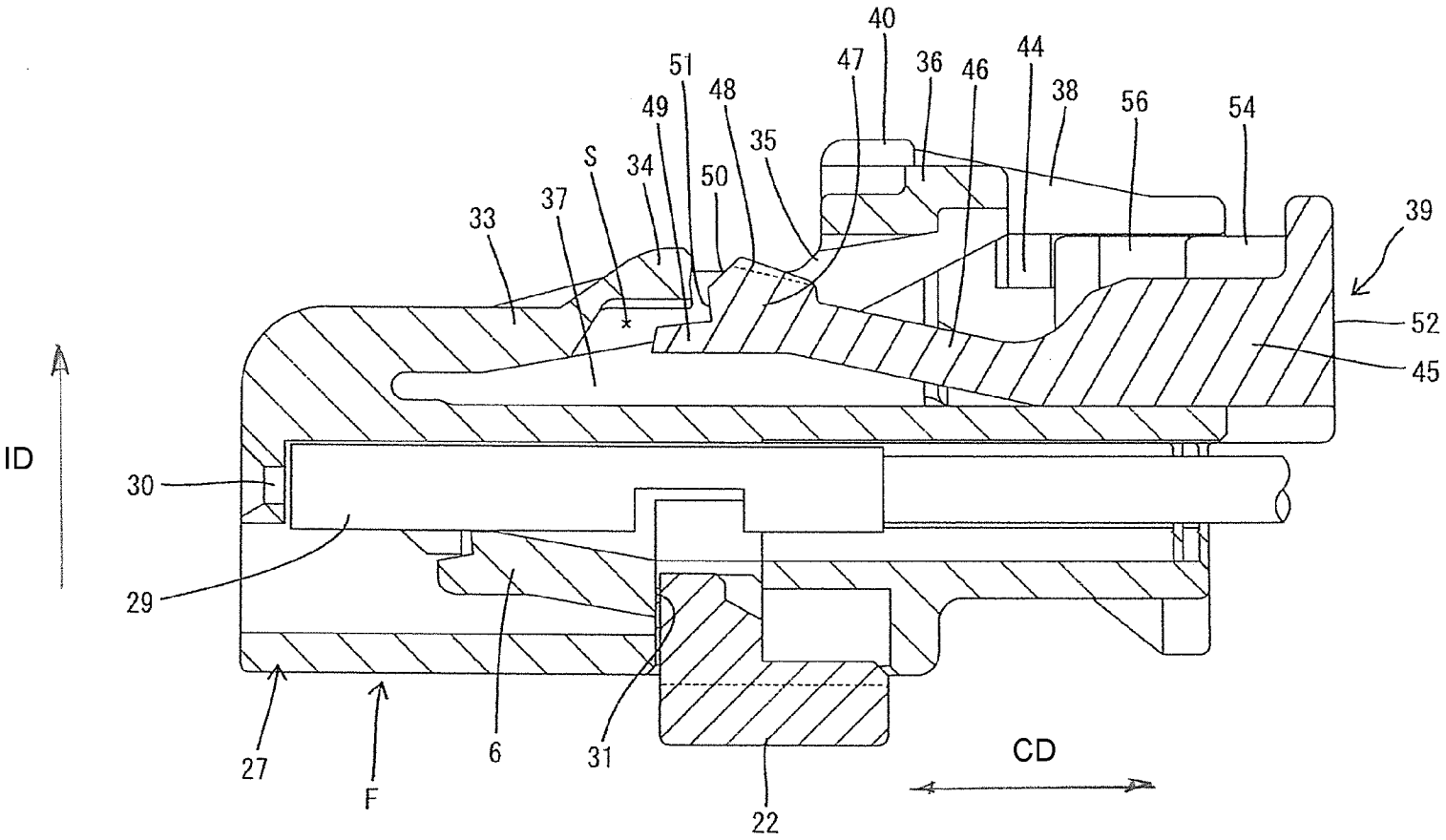
FIG. 11 is a side view in section showing a state where a detecting member is at an initial position in a female connector.
Figure 12:
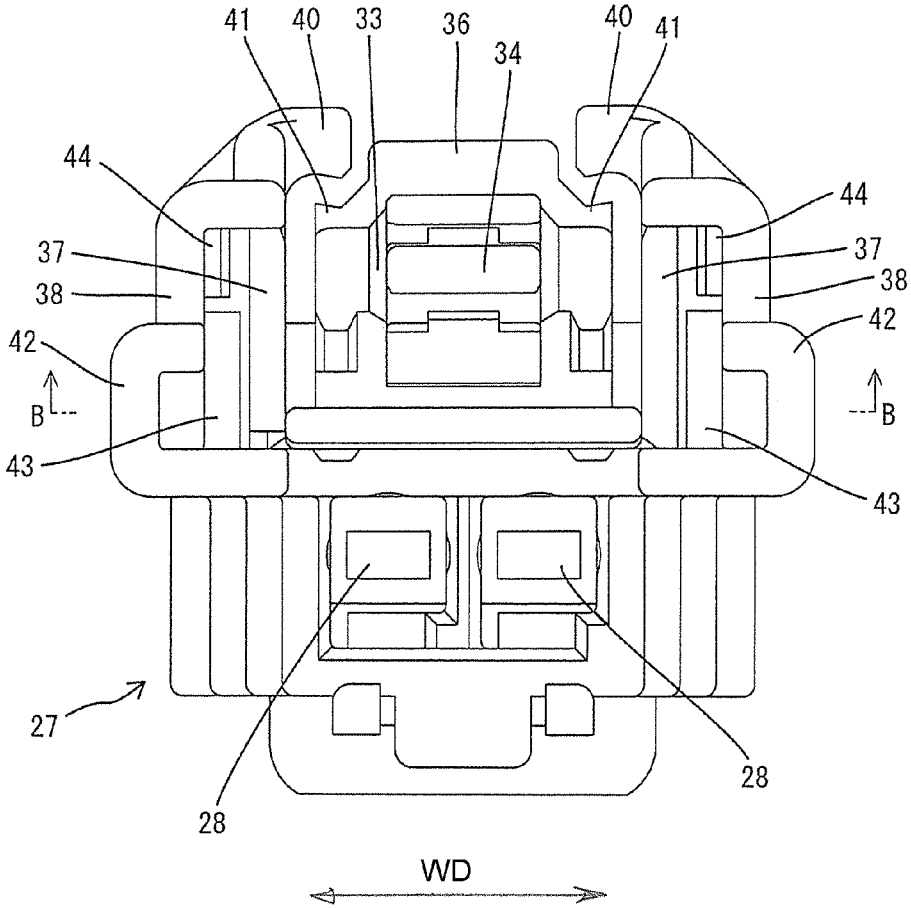
FIG. 12 is a rear view of a female connector housing.

The female connector F includes a female housing 27 made of synthetic resin and formed to fit into the receptacle 3 of the male housing 1. As shown in FIG. 12, two cavities 28 are formed side by side in the width direction in the female housing 27. As shown in FIG. 11, the cavities 28 penetrate in the front-back direction, and female terminal fittings 29 are insertable therein through rear ends, and tab insertion holes 30 are open on the front ends of the cavities 28 for receiving the tabs 5A of the male terminal fittings 5. A deflectable locking lance 6 is cantilevered obliquely forward from a lengthwise central part of each of the cavities 28 and is capable of locking the female terminal fitting 29.

As shown in FIG. 11, a retainer insertion hole 31 is open on the lower surface of the female housing 27 behind the locking lances 6. A peripheral structure including the retainer insertion hole 31 and a structure of a retainer 32 to be mounted into the retainer insertion hole 31 are as in the already described male connector M, and repeated description is omitted.

As shown in FIG. 11, a lock arm 33 is provided on the upper surface of the female housing 27 for locking the male and female housings 1, 27 in a connected state. The lock arm 33 is cantilevered back from the front end of the female housing 27 and is resiliently deformable down with a front end part as a support. A lock projection 34 projects on the upper surface of a lengthwise central part of the lock arm 33. Two couplings 35 are connected to the lock arm 33 to extend back from opposite sides of the lock projection 34. The rear ends of the couplings 35 are slightly elevated and coupled to form an unlocking portion 36. The lock projection 34 is locked to the lock 7 of the receptacle 3 when the male and female housings 1, 27 are connected properly to lock the male and female housings 1, 27 in the connected state.

As shown in FIG. 12, two lock arm protection walls 37 stand on the upper surface of the female housing 27 at opposite sides of the lock arm 33 in the width direction. The lock arm protection walls 37 extend back in the front-back direction from a front end part of the upper surface of the female housing 27 and the rear ends thereof are located slightly before the rear end of the unlocking portion 36. In a side view of the female housing 27, the lock arm protection walls 37 have a height so that only the lock projection 34 and the unlocking portion 36 project up (see FIG. 13).

Figure 14:
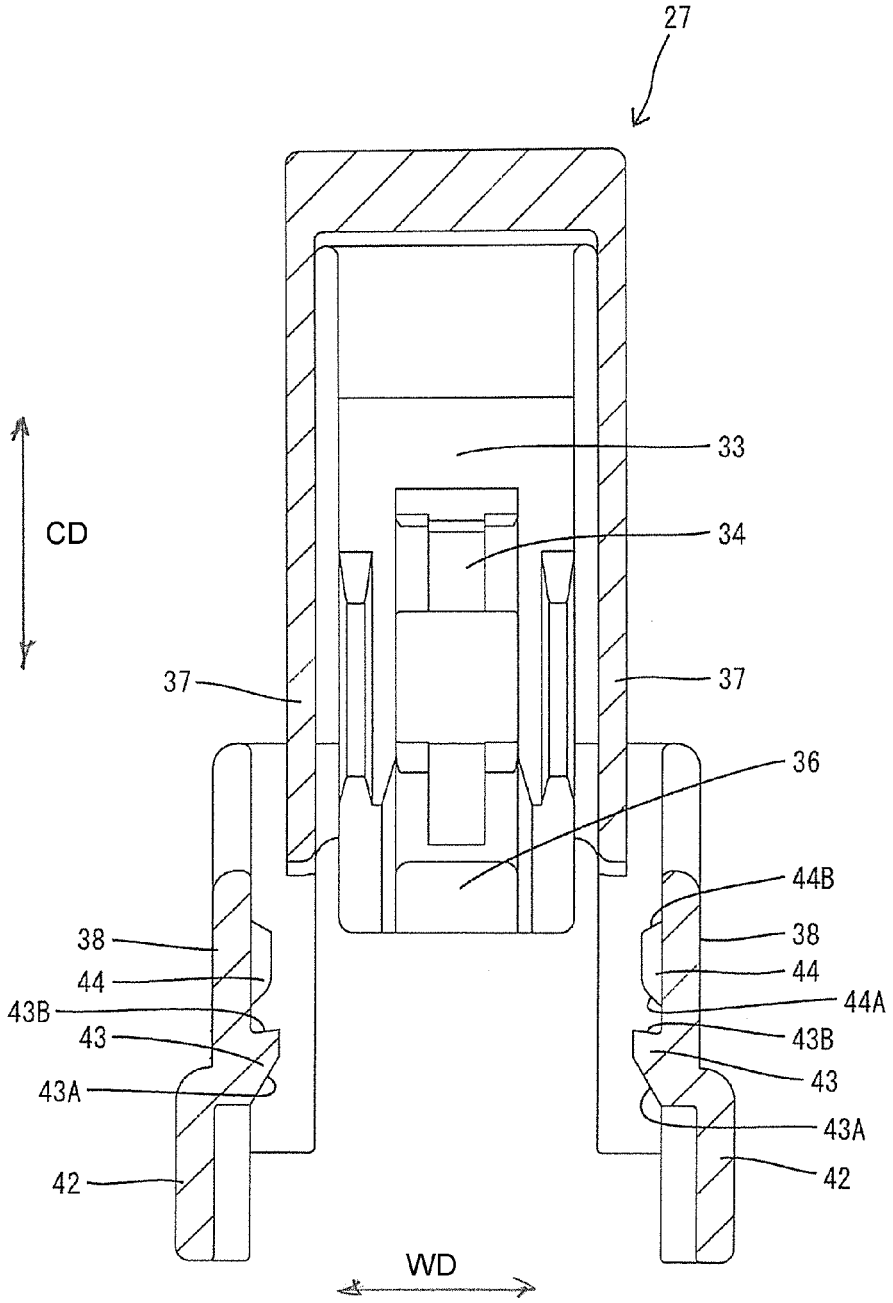
FIG. 14 is a view showing a cross-section along B-B of FIG. 12 in a vertically inverted manner.

Two detector protection walls 38 stand behind the lock arm protection walls 37 on the upper surface of the female housing 27. A space defined by the detector protection walls 38 and the upper surface of the female housing 27 defines an accommodation space for a detector 39. The detector protection walls 38 are located at outer sides of the lock arm protection walls 37 in the width direction, as shown in FIG. 12, and the rear end surfaces of the lock arm protection walls 37 are located at inner sides of the detector protection walls 38 in the width direction, as shown in FIG. 14.

As shown in FIG. 12, upper ends of the detector protection walls 38 are bent substantially at a right angle to extend inward. Further, upper end parts of the front ends of the both detector protection walls 38 project up and are bent in to form inversion preventing portions 4 that face each other in the width direction. Contrary to this, opposite side parts of the unlocking portion 36 of the lock arm 33 in the width direction protrude out in the width direction to respectively form jaws 41. Thus, the jaws 41 can contact inner sides of the inversion preventing portions 40 when the lock arm 33 is deformed up so that warping deformation of the lock arm 33 beyond its resiliency limit can be prevented.

Lower parts of the rear ends of the detector protection walls 38 protrude out in the width direction and back to form protruding frame portions 42. As shown in FIG. 12, the protruding frame portions 42 have C shapes or inverted C shapes open inward in a rear view of the female housing 27.

Figure 13:
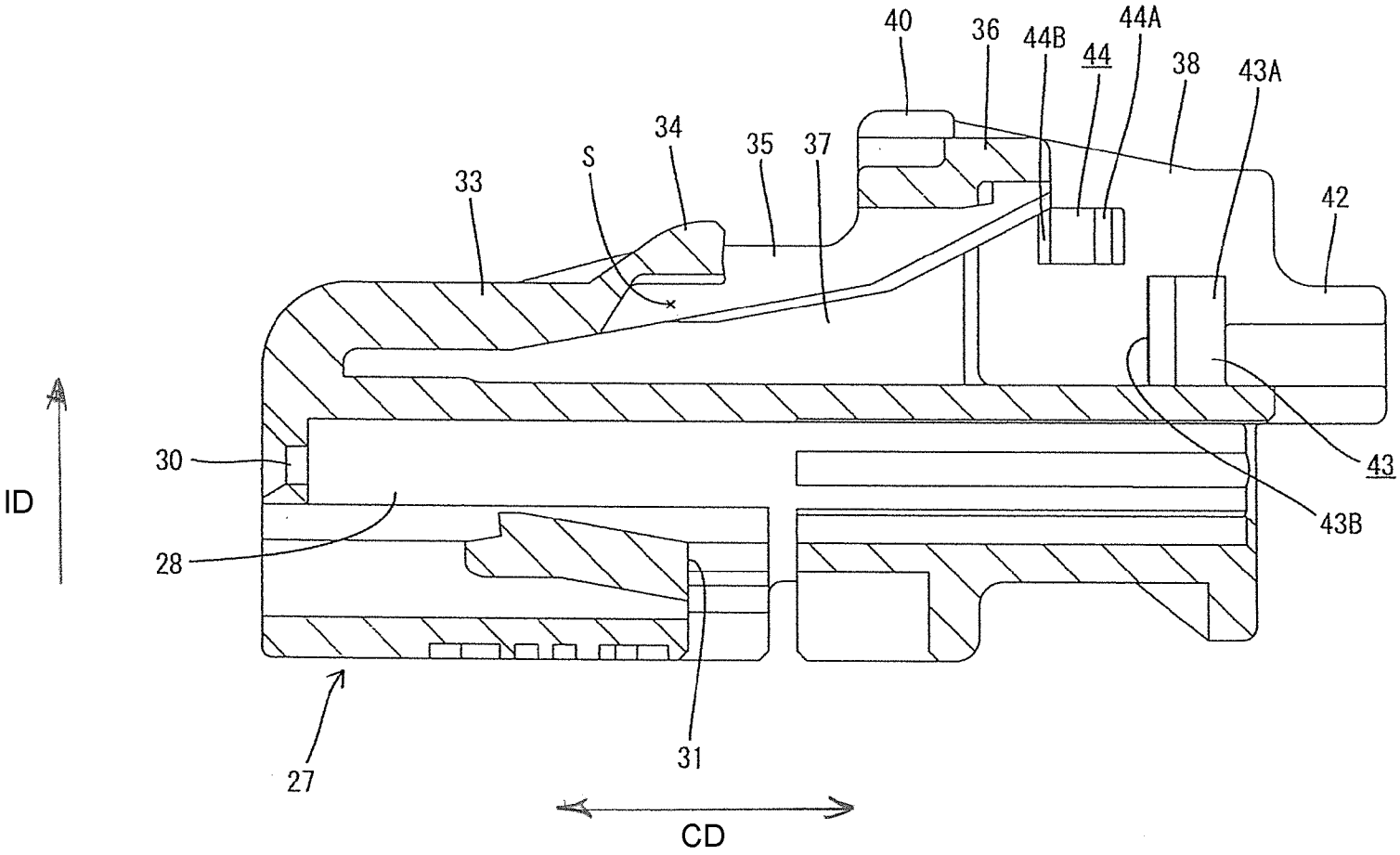
FIG. 13 is a side view in section of the female connector housing.

As shown in FIG. 13, first and second lock receiving portions 43, 44 are provided on the inner surfaces of the detector protection walls 38 while being paired in the width direction for restricting backward movement of the detector 39 at an initial position and a detecting position. As shown in FIG. 12, the lock receiving portions 43, 44 are displaced in a height direction so as not to overlap each other in the height direction in the rear view. Thus, the lock receiving portions 43, 44 can be molded by removing a mold in the front-back direction.

As shown in FIG. 14, the lock receiving portions 43, 44 are located more outward in the width direction than backward extensions of the lock-arm protection walls 37. The first lock receiving portions 43 are connected to a rear part of the upper wall of the female connector housing 27 and are at lower positions, as shown in FIG. 13. The first lock receiving portions 43 are designed to prevent the detector 39 from being detached backward from the initial position. As shown in FIG. 14, the rear surfaces of the first lock receiving portions 43 are formed into tapered surfaces 43A, but the front surfaces thereof are formed into upright lock receiving surfaces 43B.

The second lock receiving portions 44 are located before the first lock receiving portions 43 and are at higher positions to make a backward movement of the detector 39 from the detecting position difficult. As shown in FIG. 14, both front and rear surfaces of the second lock receiving portions 44 are formed into tapered surfaces 44A, 44B. However, the front and rear tapered surfaces 44A, 44B are inclined toward opposite sides and the front tapered surfaces 44B are slightly steeper and closer to upright.

Figure 15:
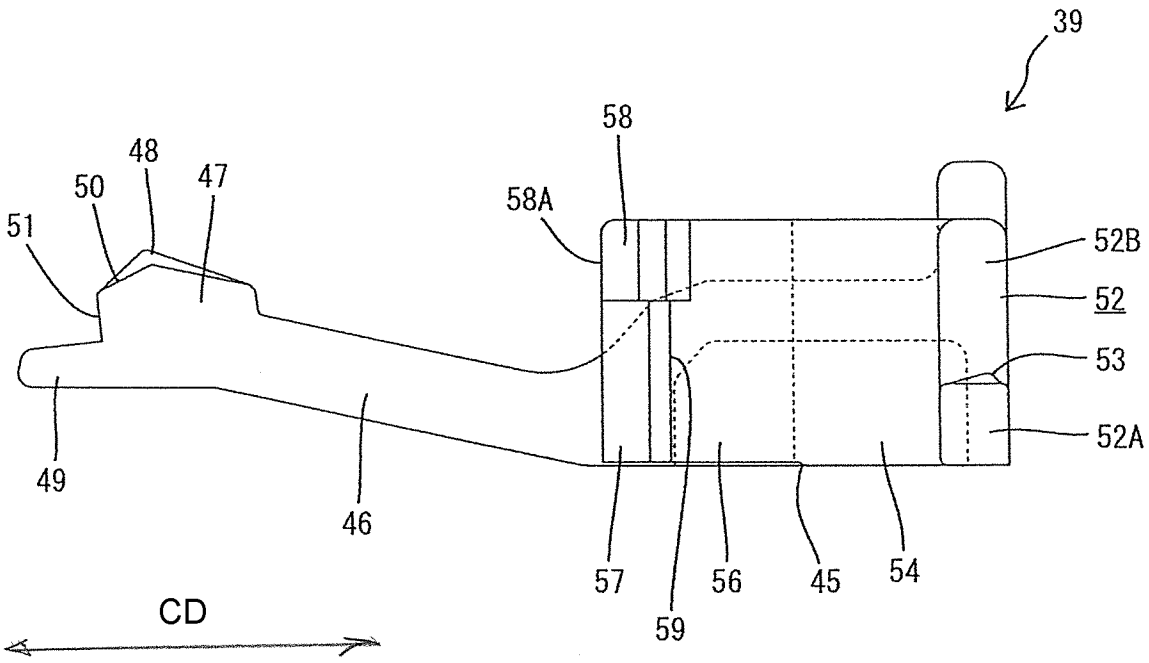
FIG. 15 is a side view of the detecting member.
Figure 16:
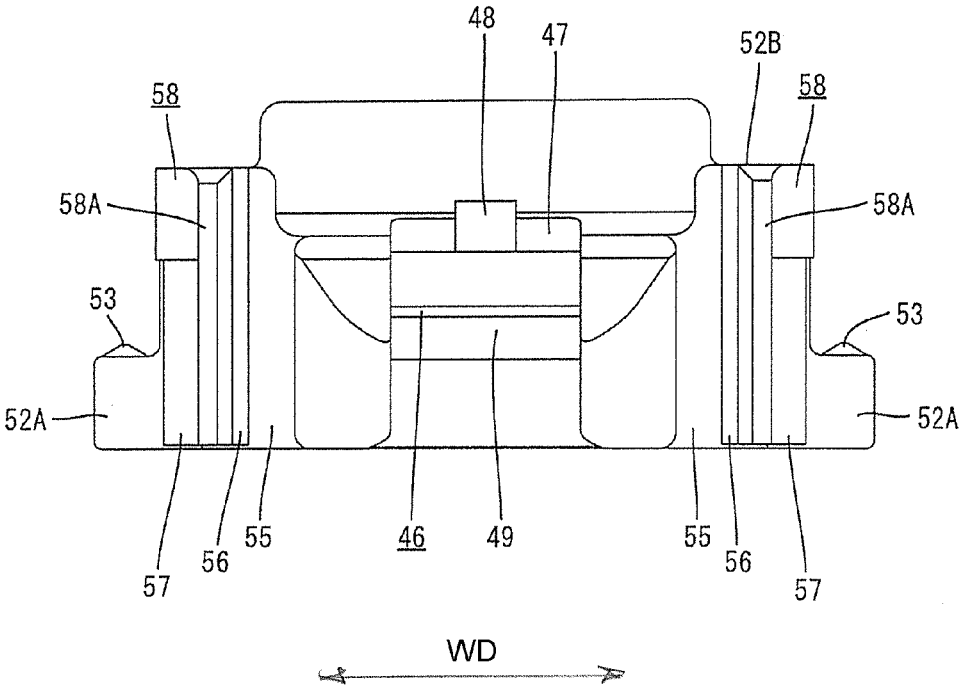
FIG. 16 is a front view of the detecting member.
Figure 17:
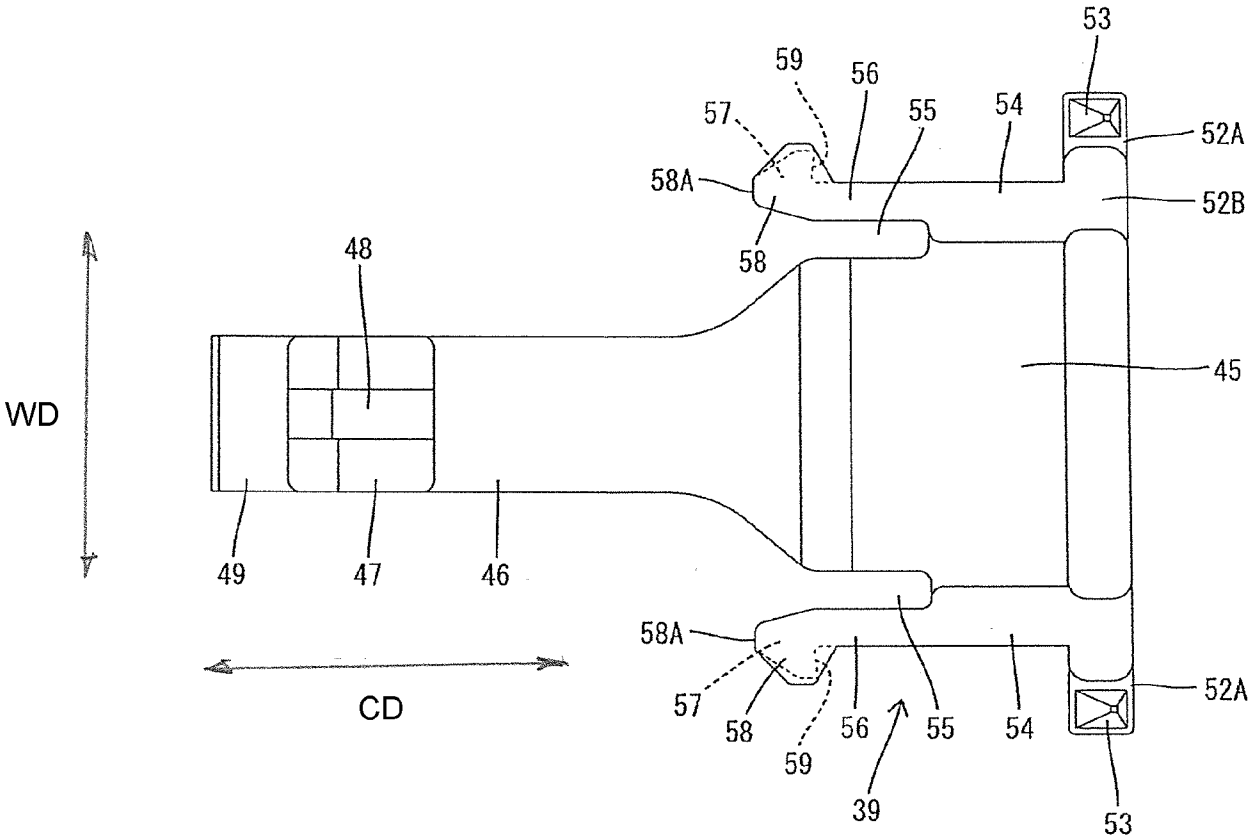
FIG. 17 is a plan view of the detecting member.

FIGS. 15 to 17 show the detector 39. The detector 39 is mounted into the female housing 27 for movement between the initial position shown in FIGS. 11 and 18 and the detecting position shown in FIGS. 19 and 20. The detector 39 can detect whether or not the male and female connectors M, F are connected properly based on whether the detector 39 can be pushed from the initial position to the detecting position.

The detector 39 is molded unitarily of synthetic resin to include a base 45 and a resilient arm 46 coupled to the front surface of the base 45. The resilient arm 46 is a substantially rectangular bar that is cantilevered forward and is resiliently deformable in the height direction with a base end as a support. In a natural state, the resilient arm 46 is inclined up toward the front.

A rectangular block-shaped protrusion 47 projects up on an upper part of the front end of the resilient arm 46. A widthwise central part of the upper surface of the protrusion 47 has a raised rib that forms an auxiliary protrusion 48. A contact portion 49 projects forward on a lower part of the front end surface of the resilient arm 46. When the detector 39 is at the initial position as shown in FIG. 11, the contact portion 49 is located in an accommodation space S defined below the lock projection 34 of the lock arm 33. Thus, when the lock arm 33 is resiliently deformed down at the time of connecting the male and female connectors M, F, the contact portion 49 is pushed down by the lower surface of the lock projection 34. Thus, the resilient arm 46 is deformed resiliently down as the lock arm 33 is deformed resiliently down.

As shown in FIG. 11, a tapered guide surface 50 is formed on the upper surface of the protrusion 47 and is inclined up toward the back. Further, a substantially upright movement restricting surface 51 is formed on the front surface of the protrusion 47. The movement restricting surface 51 faces the tip surface of the lock projection 34 and can come into contact therewith when the detector 39 is at the initial position. Thus, inadvertent movement of the detector 39 from the initial position to the detecting position is restricted.

The lock projection 34 slides in contact with the lock protrusion 7 of the receptacle 3 and the lock arm 33 is pushed down while the male and female connectors M, F are being connected. Associated with this, the resilient arm 46 also is pushed down. The lock arm 33 returns to an initial state when the male and female connectors M, F are connected properly. However, since the auxiliary protrusion 48 is pushed by the lock protrusion 7 of the receptacle 3, the resilient arm 46 is held in a pushed-down state. As a result, a contact state of the movement restricting surface 51 and the tip surface of the lock projection 34 is released and the detector 39 can move forward toward the detecting position.

The rear surface of the base 45 defines a pushing wall 52. As shown in FIGS. 15 and 16, opposite side parts of the pushing wall 52 in the width direction have a step shape in the height direction and lower end parts thereof define first steps 52A that protrude most outward. The first steps 52A can move in the protruding frames 42 while the detector 39 moves between the initial position and the detecting position. Sliding projections 53 with pointed tips project on the upper surfaces of the first steps 52A and function to reduce sliding resistance when the detector 39 is pushed by coming into substantially point contact with ceiling surfaces in the protruding frames 42. Further, second steps 52B of the pushing wall 52 are higher than the upper surface of the base 45, and two side walls 54 extend forward from the front surfaces of the second steps 52B. The side walls 54 are formed to fit into spaces at inner sides of the detector protection walls 38 of the female housing 27.

As shown in FIG. 17, two slits 55 are formed between front end parts of the side walls 54 and the base 45 to extend from the front end surfaces of the side walls 54, and two deflectable locking arms 56 are formed at outer sides of the slits 55 in the width direction.

The locking arms 56 are formed to be deflectable inwardly in the width direction. Further, as shown in FIG. 16, first and second claws 57 and 58 are provided one above the other on tip parts of the locking arms 56 while projecting outward. The first claws 57 are located at lower positions and can be locked to the first lock receiving portions 43 of the female housing 27. The rear surfaces of the first claws 57 are formed into upright locking surfaces 59, as shown in FIG. 15, and are locked to the lock receiving surfaces 43B of the first lock receiving portions 43 when the detector 39 is at the initial position. At this time, the locking surfaces 59 and the lock receiving surfaces 43B, which are both upright surfaces, are locked to each other. Therefore a backward detachment of the detector 39 located at the initial position is restricted strongly.

Figure 18:
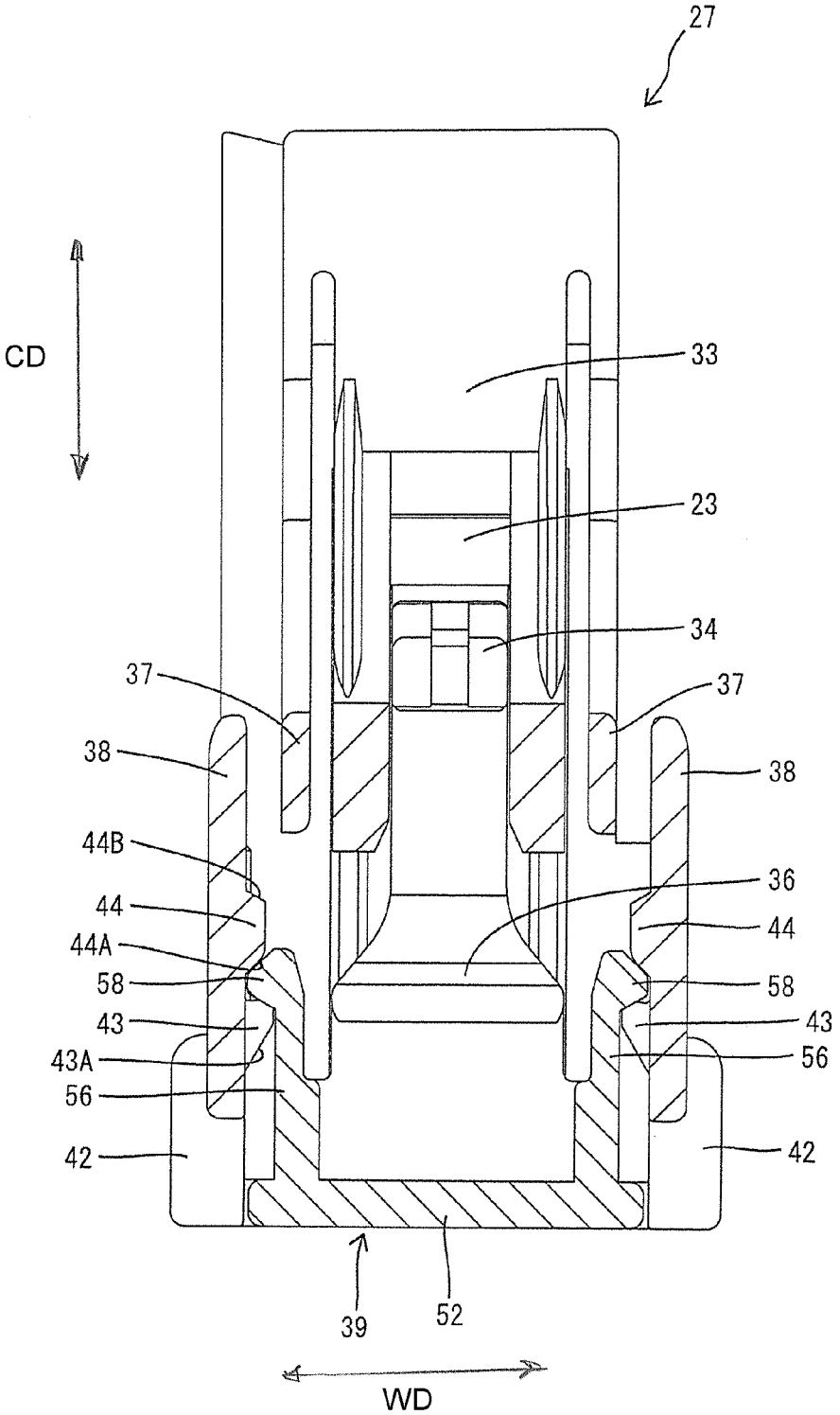
FIG. 18 is a view, corresponding to FIG. 14, when the detecting member is at the initial position.

Conversely, both front and rear surfaces of the second claws 58 are tapered surfaces. The front surfaces 58A extend in the width direction, i.e. surfaces extending along a direction perpendicular to a pushing direction of the detector 39. Accordingly, when the detector 39 is at the initial position, the second claws 58 are in contact with the rear surfaces of the second lock receiving portions 44, as shown in FIG. 18, thereby restricting a forward movement of the detector 39 in an auxiliary manner. Further, when the detector 39 is at the detecting position, the front end surfaces 58A face the rear end surfaces of the lock-arm protection walls 37 and can come into contact therewith while the second claws 58 are locked to the second lock receiving portions 44 as shown in FIG. 19, thereby preventing the detector 39 from being pushed further forward from the detecting position.

Figure 19:
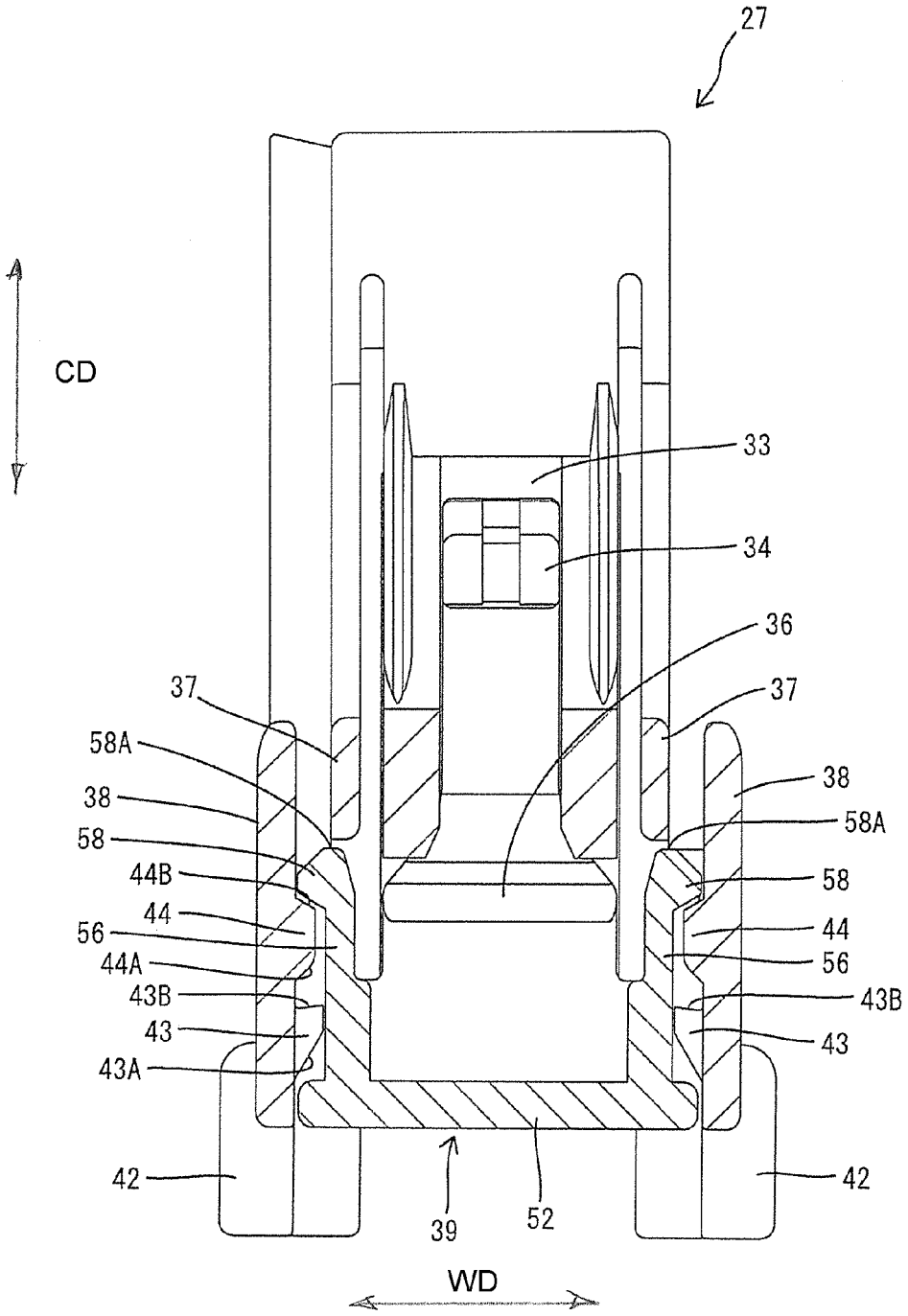
FIG. 19 is a view, corresponding to FIG. 14, when the detecting member is at a detecting position.
Figure 20:
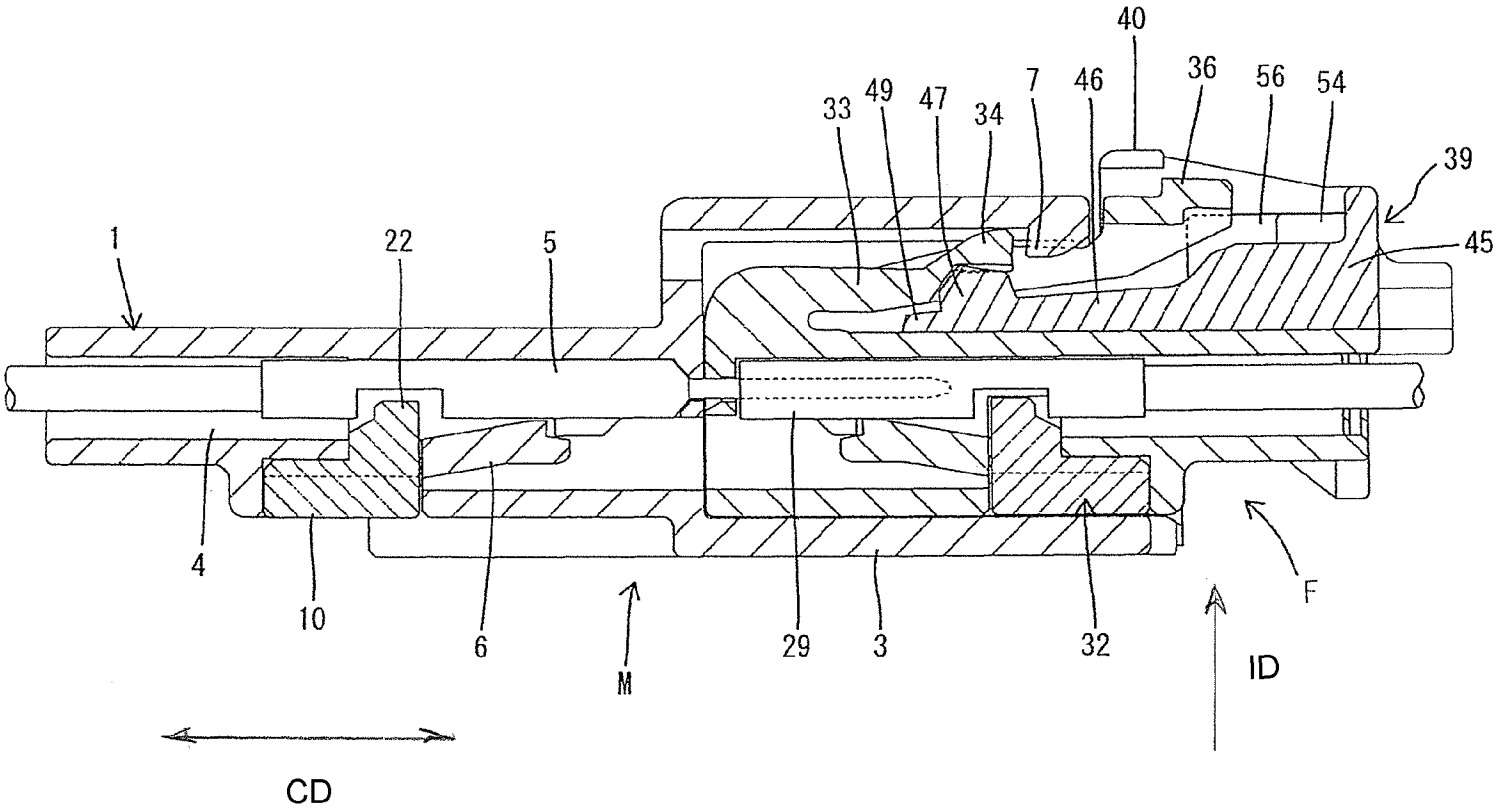
FIG. 20 is a side view in section showing a state where the male and female connectors are properly connected.

As shown in FIGS. 18 and 19, both locking arms 56 are located substantially on backward extensions of the lock-arm protection walls 37 when the detector 39 is at the initial position and the detecting position. When being resiliently deformed inwardly, both locking arms 56 cross these extensions toward widthwise inner sides. In this way, dead spaces behind the lock-arm protection walls 37 can be utilized as deflection spaces for the locking arms 56.

The retainer 10 is held in a partly locked state, as shown in FIG. 9, when mounting the male terminal fittings 5 into the male housing 1. At this time, the locking protrusions 22 of the legs 20 are both retracted outward from the cavities 4. Therefore the male terminal fittings 5 can be inserted into the cavities 4. The male terminal fittings 5 inserted to proper positions are locked primarily by the locking lances 6.

The pushing surface 19 of the retainer 10 then is pushed in the inserting direction ID, and the legs 20 deform resiliently inward to unlock the locking claws 21 from the partial lock receiving portions 16. Thus, the entire retainer 10 is inserted into the retainer insertion hole 8 in the inserting direct ID. When the retainer 10 reaches the full locking position, the locking claws 21 are locked to the full lock receiving portions 17 and the locking protrusions 22 are inserted into the cavities 4 to lock the male terminal fittings 5. Therefore the male terminal fittings 5 are retained doubly by the locking protrusions 22 together with the locking lances 6.

Note that an operation of mounting the female terminal fittings 29 into the female connector housing 27 can be performed in the same manner as described above.

The detector 39 is held at the detecting position in the female connector F before being connected to the male connector M. When the male and female connectors M, F are connected in this state, a tip side of the female housing 27 is fit into the receptacle 3 and the lock projection 34 of the lock arm 33 contacts the front end of the lock protrusion 7 of the receptacle 3 in this connecting process. The lock arm 33 receives a downward pushing force from the lock protrusion 7 and deforms resiliently down as the connecting operation progresses. The contact portion 49 of the resilient arm 46 of the detector 39 also receives a downward pushing force as the lock arm 33 is pushed down and is deformed resiliently down.

The male and female terminal fittings 5, 29 are connected properly when the male and female connectors M, F are connected to a proper depth and the lock arm 33 returns. Thus, the lock projection 34 is locked to the inner surface of the lock protrusion 7 of the receptacle 3. At this time, the lock protrusion 7 of the receptacle 3 is in contact with the auxiliary protrusion 48 of the resilient arm 46. Thus, the resilient arm 46 is kept resiliently deformed down. At this time, a contact state of the movement restricting surface 51 of the resilient arm 46 and the tip surface of the lock projection 34 of the lock arm 33, i.e. a movement restricted state of the detector 39, already is released. Thus, the guide surface 50 of the protrusion 47 of the resilient arm 46 slides in contact with the lower edge of the tip of the lock projection 34 of the lock arm 33 when the pushing wall 52 is pushed. Thus, the detector 39 reaches the detecting position while pushing the resilient arm 46 farther down. At this position, the protrusion 47 of the resilient arm 46 is inserted between the lock projection 34 of the lock arm 33 and the upper surface of the female housing 27 to be held substantially in contact with both. Thus, the deflection of the lock arm 33 in an unlocking direction is restricted, and the male and female connectors M, F are locked reliably in the connected state.

Further, when being pushed before reaching the detecting position, the detector 39 is no longer held at the initial position where the first claws 57 of the locking arms 56 and the first lock receiving portions 43 are locked to each other. Then, the locking arms 56 are deflected inward and the second claws 58 move over the second lock receiving portions 44. When the detector 39 reaches the detecting position, the second claws 58 are locked to the second lock receiving portions 44 and the front end surfaces 58A of the second claws 58 contact the rear end surfaces of the lock-arm protection walls 37, thereby preventing the detector 39 from moving any farther forward.

The retainer 10 is configured so that the extended portions 11 are provided to extend from the body 18 and the extended portion side pushing surfaces 19B are formed in addition to the body side pushing surface 19. This enables the entire retainer 10 to be pushed easily even if the retainer 10 is small. Further, since the pushing surface 19 is extended toward one side (rear side) from the body 18, an insertion posture into the retainer insertion hole 8 tends to be inclined. However, the posture correcting portion 23 is provided and the retainer 10 can be corrected to have a proper insertion posture instead of having an inclined posture by fitting the tip part of the posture correcting portion 23 into the cut recess 15 of the partition wall 14 (see FIG. 8).

Since the posture correcting portion 23 is provided between the legs 20 in the retainer 10, the posture correcting portion 23 can also function to prevent excessive deformation of both legs 20.

The backlash filling projections 25 project on the widthwise side surfaces of both extended portions 11 of the retainer 10 and are squeezed by the inner surfaces of the opposite side walls when the retainer 10 is at the full locking position. Thus, the extended portions 11 are sandwiched tightly between the center wall and the side walls and the entire retainer 10 can be held without play in the width direction. Furthermore, the backlash restrictions 26 project out in the width direction on the retainer 10 and fit substantially tightly into the corresponding positioning recesses 13 of the male housing 1 when the retainer 10 is at the full locking position. Thus, the retainer 10 can be held without play in the front-back direction.

The locking arms 56 of the female connector F are located substantially on the backward extensions of the lock-arm protection walls 37 when the detector 39 is at the initial position and the detecting position. When deformed resiliently inward, both locking arms 56 cross these extensions toward the widthwise inner sides. Specifically, the locking arms 56 are arranged utilizing the dead spaces behind the lock-arm protection walls 37 and are resiliently deformed inward. Thus, the connector can be smaller in the width direction as compared with locking arms that are deformed resiliently outward.

In the female housing 27, since the first and second lock receiving portions 43, 44 for holding the detector 39 at the initial position and the detecting position are displaced so as not to overlap in the height direction, these can be formed by a mold that is opened and closed in the front-back direction. Thus, a mold structure for the female housing 27 can be simplified.

When the detector 39 is at the initial position, the tip of the resilient arm 46 of the detector 39 is in contact with the lock arm 33 and the second claws 58 of the locking arms 56 are in contact with the rear surfaces of the second lock receiving portions 44. Thus, a forward movement is restricted reliably at the initial position. Further, at the initial position, the first claws 57 are locked to the first lock receiving portions 43 and the locking surfaces and the lock receiving surfaces thereof are upright surfaces. Thus, a situation where the detector 39 is detached outwardly at the initial position can be prevented reliably.

When the detector 39 is at the detecting position, the front end surfaces 58A of the second claws 58 of the detector 39 are in contact with the rear end surfaces of the lock-arm protection walls 37 so that a forward movement can be restricted. Simultaneously, the second claws 58 are locked to the front surfaces of the second lock receiving portions 44 to prevent a return to the initial position.

The invention is not limited to the above described and illustrated embodiment. For example, the following embodiments are also included in the technical scope of the present invention.

Although the extended portions of the retainer are extended toward one side (rear side) of the body in the above embodiment, they may be extended toward both front and rear sides.

Although the posture correcting portion of the retainer also functions to prevent excessive deformation of the both legs in the above embodiment, a posture correcting function and an excessive deformation preventing function may be set at different positions.

Although the posture correcting portion of the retainer is locked to the cut recess formed on the partition wall to correct the posture of the retainer in the above embodiment, it may be locked at a position other than the partition wall.

Although the deflection of the lock arm is restricted when the detector reaches the detecting position in the above embodiment, the deflection may not be necessarily restricted.

The invention claimed is:

1. A connector, comprising:

terminal fittings;

a housing with cavities for accommodating the terminal fittings, the cavities being spaced from one another in a width direction and extending through the housing in a connecting direction that is transverse to the width direction, the housing further being formed with a retainer insertion hole extending into the housing in an inserting direction that is transverse to the connecting direction and the width direction, the retainer insertion hole intersecting the cavities; and a retainer mounted in the retainer insertion hole and configured to lock and retain the terminal fittings in a mounted state in the cavities, the retainer including:

a body provided with a housing locking portion to be locked to an inner part of the housing and terminal locking portions to be locked to the terminal fittings, the housing locking portions being deflectable in the width direction, the terminal locking portions projecting in the inserting direction and being spaced from one another in the width direction, and the body further having a pushing surface at a rear end in an inserting direction into the housing;

an extended portion extending from the pushing surface in the connecting direction and being continuous and flush with the pushing surface; and a posture correcting portion between and spaced from the terminal locking portions in the width direction and being disposed and configured for contacting the housing in the connecting direction when the retainer is mounted into the housing, the posture correcting portion being formed to fit into a recess in a partition wall between the cavities along the connecting direction for restricting inclination of the retainer.

2. The connector of claim 1, wherein the posture correcting portion contacts the housing locking portions when the housing locking portions are resiliently deformed within a resiliency limit and prevents excessive deflection of the housing locking portions.

3. The connector of claim 1, wherein the retainer is formed with at least one protruding backlash restricting portion, and the housing is formed with at least one positioning recess into which the backlash restricting portion is fit at the time of mounting the retainer to be tightly held in the connecting direction.

* * * * *